United States Patent [19]

Haight

[11] 4,319,995

[45] Mar. 16, 1982

[54] PROCESS AND APPARATUS FOR SEPARATING PARTICLES BY RELATIVE DENSITY

[75] Inventor: William J. Haight, Pleasantville, N.Y.

[73] Assignee: Mineral Recovery Corporation, Pleasantville, N.Y.

[21] Appl. No.: 249,223

[22] Filed: Mar. 30, 1981

[51] Int. Cl.[3] ..... B07B 13/00

[52] U.S. Cl. ..... 209/481; 209/494

[58] Field of Search ..... 209/471, 472, 477, 485, 209/479–481, 494; 222/161, 196, 199

[56] References Cited

U.S. PATENT DOCUMENTS

| | | | |
|---|---|---|---|
| 3,399,771 | 9/1968 | Hryniowski | 209/366.5 X |
| 3,563,420 | 2/1971 | Ansley | 222/199 |
| 3,853,247 | 12/1974 | Wahl | 222/199 |
| 4,206,046 | 6/1980 | Haight | 209/485 X |
| 4,276,157 | 6/1981 | Haight | 222/199 X |

*Primary Examiner*—Ralph J. Hill

*Attorney, Agent, or Firm*—Morgan, Finnegan, Pine, Foley & Lee

[57] ABSTRACT

A particle separation method and apparatus carrying forward the teachings of U.S. Pat. No. 4,148,725 whereby separation of particles by density takes place in a size-classified fluidized bed of particles. Particles are disposed on a supporting surface having a plurality of generally concentric annular vertical reaction surfaces which together forms a plurality of annular channels occupied by the particles to be separated. The supporting surface and annular surfaces are agitated with a gyratory motion so as to induce particles in the fluidized bed to move within channels, and through openings between annular channels, toward a central collection zone.

In the improved apparatus, the collection zone includes a plurality of vertically spaced horizontal reaction surfaces which enhance the fluidity of particles within that zone. A vertical barrier surface provides a smaller, annular zone of concentration at the center of the collection zone.

Another improvement includes a cover over the top of the annular channels for contacting denser particles dispersed over the top of the fluidized particle bed and driving them downwardly into the channels. Any dispersed particles not driven downwardly are permitted to exit from an aperture as light density waste.

44 Claims, 6 Drawing Figures

PROCESS AND APPARATUS FOR SEPARATING PARTICLES BY RELATIVE DENSITY

RELATED APPLICATIONS

This application carries forward the teachings of my earlier U.S. Pat. No. 4,148,725, issued on Apr. 10, 1979.

FIELD OF THE INVENTION

This invention relates to certain improvements in the separation and concentration of particles according to relative mass and/or density. In particular, it relates to an improved process and apparatus wherein particles in an aggregated mass of size-classified particles are contacted with various reaction surfaces so as to fluidize the particle bed and cause particles within such bed to move in a preferred direction for density separation or concentration of the feed material. The process is especially useful in the concentration of dry particulate ores and minerals, where the process can be applied to upgrading the feed material. For example, the invention readily enables the concentration of dense particles, such as gold or other metal particulates, from a much larger volume of less dense dry sand or gravel of the same general particle size classification.

The invention is remarkably effective in separating dense particles from a homogeneous flowable bed of particles of different densities, if the particles have been properly classified so as to maintain a difference in mass between the selected particles and the remaining, or waste, particles. It therefore has promising use in the concentration of placer ores which cannot be concentrated by washing and sluicing where water is unavailable. Even where such a placer is economic in its raw state, it can be made more profitable by using the invention to reduce the volume of raw feed material that must be transported and/or conventionally processed. Similarly, the invention may be used to recover particles from particulate waste according to relative mass or density.

BACKGROUND OF THE INVENTION

Known processes for separating and classifying particles contained in an aggregate particle mass are truly numerous. Many of these processes are limited to separating particles according to size (classifying) as, for example, the traditional and common screening and size-separating processes. Other processes are effective in separating particles in accordance with their weight or shape. The present invention relies heavily on differences in density among the classified particles in a dry fluid bed, and can be used in combination with other types of separation techniques.

One of the oldest methods for separating heavier materials from lighter crushed materials is the riffle board, or riffle pan, in which crushed ore is placed upon a corrugated surface set at an incline and flushed with water. During separation, the riffle board is moved back and forth in directions normal to the corrugations, or is otherwise vibrated so as to create relative motion between the particles and the riffled surface. The ligher ore tends to carry over the corrugations (riffles) farther from the point of feed than the heavier minerals, and the crushed materials therefore are carried by the water over the edge of the riffle board at different locations.

A disadvantage in the riffle board separation process is its requirement for the continuous flow of fluid over the riffles. In addition, the riffles are necessarily restricted in dimension and thus a limit is placed upon the amount of material which can be contained by any riffle, and thereby upon the amount of material which may be separated in a given amount of time.

Another technique for upgrading crushed ore particles is found in U.S. Pat. No. 3,349,904. There a rotating screen in the form of an inverted cone receives the aggregate particle mass while air is simultaneously blown up through the screen to create an upward pressure. Heavier metal particles are intended to overcome the upward air blast pressure and be separated out of the mass by falling through the screen, while lighter rock particles are thrown upwardly and outwardly to the periphery of the screen due to centrifugal force. One major disadvantage in attempting to separate particles by this method is the high degree of complexity of the apparatus and the requirement for a pressurized air source. An obvious limitation is that material sized larger than the screen openings, even if having the selected density, cannot be handled. Furthermore, although it may be possible to separate particles whose densities are grossly disparate, it is believed that particle size must be very carefully controlled where the density of the desired material (such as crushed ore) approaches the density of the waste material.

Particle handling equipment may use a gyratory separator (or "classifier") such as that disclosed in U.S. Pat. No. 2,950,819. A particle mixture is placed upon a vibratory screen designed to pass particles of all sizes smaller than the screen openings and irrespective of the particles' densities. Separators of this type are usually operated to cause all over-size particles to move to the periphery of the screen to be discharged. It is possible, however, to operate such devices so that oversize particles do not discharge due to a tendency for them to move radially inwardly to the center of the screen where they are retained as is shown, for example, in U.S. Pat. No. 3,794,165 (FIGS. 7–10). In certain cases, these separators are used to remove or recover particles entrained in liquid, the latter flowing through the screen and leaving behind particles trapped by the vibratory screen. These particles are flushed down an outlet at the screen's center.

In all cases, so far as is known, gyratory separators have not been adapted to or operated for separating particles in accordance with the relative densities. Even in cases where particles are retained on the vibratory screen, no provision was made for separately segregating or extracting those remaining particles according to their densities.

Still another known separation technique is based upon a mechanical concentrator known as the Denver mechanical concentrating pan which duplicates the miner's hand-panning motion. This device consists of a series of classifying screens under which are placed several pans specially coated to trap the fine heavy materials (e.g., gold). The first pan is metal-coated with mercury to amalgamate free gold; the remaining pans receive the overflow from the first and are coated with a rubber matting covered with screening which acts like a riffle. The entire assembly is driven with an eccentric motion in order to swirl the material in water, which is added along with the particle mixture to settle the mineral. Like other processes, this technique requires a flow of water and its collection capacity of the heavier fines is limited by the amalgamation and riffle capacity of the concentrating pans. It thus must be stopped periodically and emptied of the concentrated materials.

A similar principle is used in devices such as shown in U.S. Pat. No. 1,141,972 to Muhleman, where a rotary tilting motion is imparted to a pan having a riffled floor surface. Concentrated ore is extracted from a hole in the center of the pan floor. Again, the motion of the pan is such that the waste material swirls about the edge of the pan and is discharged, whereas heavier material gravitates toward the center due to the tilting.

In my U.S. Pat. No. 4,148,725, I disclose a new process and apparatus wherein a size-classified bed of particles is fluidized by agitating a supporting surface with a gyratory motion to fluidize the particle bed. Particles are contacted with vertically projecting annular surfaces movable with the supporting surface and defining two or more annular channels. Particles within these regions are given sufficient fluidity by their reaction against the surfaces to allow them to move within the particle bed and distribute themselves according to their relative densities. Thus, particles move from one channel to the next through restricted openings in the annular surface, the denser particles tending to accumulate in one channel and the less dense particles being displaced into adjacent channels. The dense particles migrate in the direction of the eccentric "throw" toward a collection zone. Their greater energy, or momentum, it is thought, is what causes them to remain in the collection zone and displace less dense particles there.

In accordance with the teachings of said U.S. Pat. No. 4,148,725, particles may be added to the fluidized particle bed at one of the interior annular channels so that waste material (e.g., less dense particles) flows outwardly. The denser particles, on the other hand, tend to be given a net inward momentum where they collect at the central collection region.

The foregoing process and apparatus functions effectively when recovering dense particles from a bed of coarse sand when operating on either a continuous basis or a "batch" basis. In processing by batch, a fixed amount of feed material is loaded into the apparatus, which then is operated for a given period of time and shut down. Thereupon the densified, or upgraded, concentrate is extracted. It was found, however, that a problem sometimes arose when attempting to separate dense particles from fine sand, e.g., sand finer than −30 mesh. In such case, the sand tends to become compacted in the collection zone to such a degree that dense particles sought to be recovered cannot move through the compacted mass and, accordingly, may not reach the collection zone.

There are, perhaps, many reasons for the above phenomenon; however, the interrelated motion of the particles and the reaction surfaces is so complex that a dispositive analysis cannot be readily made. Because the net force on all particles tends to drive them toward the collection zone, it has been observed that particles tend to be more compacted at the center of the bed. Another explanation may be that the vertical displacement of the gyratory motion at the center of the bed is at a minimum, the maximum vertical displacement occurring at the bed periphery. Thus, it is possible that the fluidity of particles moving toward the center of the bed diminishes excessively due to a reduction in this vertical displacement.

Another problem that has been experienced is the limitation in the flow rate through the gyratory apparatus. When the equipment was operated in a continuous flow mode, high flow rates had to be avoided in order that the dense particles not be carried out of the bed with the less dense waste material. Separation times, therefore, could be much longer than is ordinarily acceptable for some commercial operations. On the other hand, if the equipment were operated on a batch basis to avoid inadvertent loss of dense particles, through-put is reduced. This is because particles have to be given sufficient residence time in order to penetrate the particle bed and collect in the collection zone. The amount of particles that can be batch processed at any one time is limited to the bed capacity, as the apparatus must be periodically stopped to remove the particles before additional particles may be introduced into the bed.

SUMMARY OF THE INVENTION

In general, the present invention carries forward the teachings of my prior U.S. Pat. No. 4,148,725 with several refinements which enhance their efficiency and effectiveness and which extend their usefulness to a greater range of feed materials. This is achieved in part by improving the fluidity of the particle bed within the collection zone, by providing means of adding particles to the bed and dispersing them during a continuous separation process, and by acting upon dispersed particles in such a way that the more dense particles which are to be separated out are caused to enter the fluidized particle bed while permitting the less dense particles to be discharged as waste.

Although each of the foregoing features may be independently incorporated into the separation technique advantageously, a synergistic effect is realized when employing at least two, and preferably all, of these features.

As noted above, the apparatus includes a plurality of annular concentric channels formed by a plurality of rings constituting the vertical reaction surfaces. Each ring has a narrow opening therein so that particles may move from one channel to the next under the influence of the motion of the reaction surfaces. This motion preferably is a gyratory motion having a circularly eccentric motion component and a repetitive vertical motion component.

The present invention improves the process and apparatus of my issued patent by using additional reaction surfaces that control the behavior of particles within the particle bed. Such particle behavior is brought about by one or more of the following:

(1) contacting the particles with a plurality of spaced-apart horizontal reaction surfaces disposed in the collection zone so as to enhance the fluidity of particles and thereby to increase the ability of particles of greater density to move into and remain in the collection zone in preference to particles of lesser density;

(2) dispersing added excess particles over the top of the fluidized bed for reception into the annular separation regions;

(3) contacting excess particles flowing over the top of the bed with a laterally extending reaction surface having a repetitive vertical motion so as to cause contacted particles to be driven downwardly into the fluidized bed; and (4) exposing particles in the collection zone to a vertical barrier surface against which more dense particles may react to displace less dense particles.

The preferred embodiment employs a concentrate zone associated with the collection zone, from which the concentrate may be extracted. Particles gain access to this concentrate zone through apertures communicating with the collection zone. When operating in the continuous mode, the more dense particles entering the concentrate zone can be removed therefrom by suction, thus permitting the upgraded concentrate to be continuously removed during the separation operation.

When the foregoing improvements are utilized together, particles can be continuously added to the particle bed and dispersed over the top of the bed where they are contacted by the laterally extending reaction surface, giving the denser particles a net downward momentum into the fluidized bed while permitting the less dense particles to disperse away from the point of particle addition to an exit aperture for extraction. In the collection zone, fluidity of the particle bed is enhanced so as to diminish the resistance of the particle bed to movement of the more dense particles into the collection zone and ultimately into the concentrate zone. This enhanced fluidity is brought about by the spaced-apart horizontal reaction surfaces which are more effective in transmitting the vertical reciprocal impact of the gyratory motion to the particles in the collection zone.

For a better understanding of the invention, together with its objects and advantages, reference may be made to the following detailed description and to the drawings.

DESCRIPTION OF THE PREFERRED EMBODIMENTS

General Description

Figure 1:
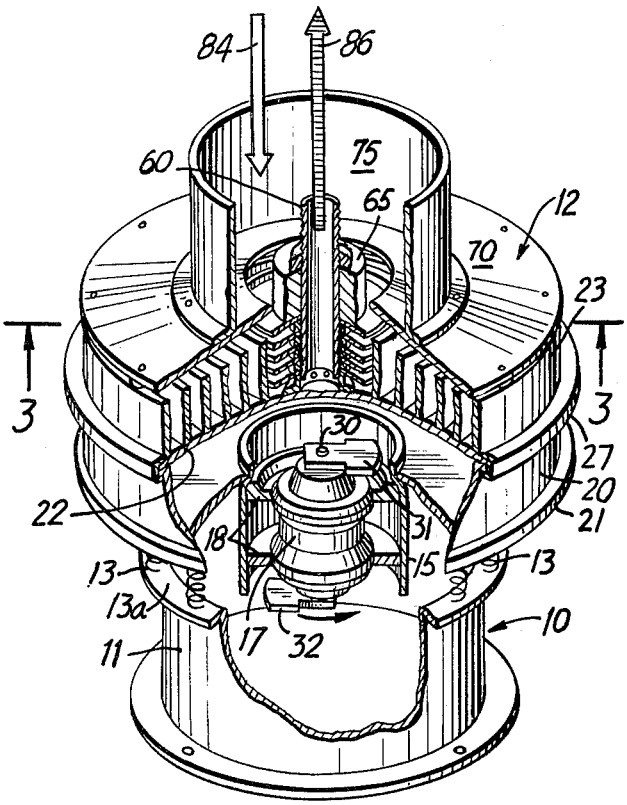
FIG. 1 is a cut-away perspective view of a gyratory separation apparatus implementing the present invention.

Turning first to FIG. 1, the process of the invention is carried out by apparatus which includes a gyratory separator machine, designated generally by the numeral 10, and a separation head 12 implementing the improvements earlier described. It will be understood that the machine 10 is a commercial apparatus whose function is to impart a gyratory motion to the separation head 12. Separation of the dense particles from the less dense particles occurs as a result of the control exerted on the particle bed by the improved separation head 12 in response to that motion.

The vibratory device includes a cylindrical base 11 and a plurality of compression springs 13 circumferentially spaced about the upper lip 13*a* of the base for supporting a flat table 14. This table carries at its center of cylindrical motor mount 15 that extends down into the center of base 11. A motor 17 is supported within the mount 15 by a pair of annular flanges 18, such that the motor is rigidly affixed to the table 14. Vibrations induced by the motor are therefore transmitted directly to the table. A cylindrical spacing frame 20, secured by clamping ring 21 at the periphery of the table, extends upwardly for supporting the separation head 12. The entire upper section 12 is clamped by a ring 27 to the rim of the lower frame 20.

A shaft 30 extends from each end of the motor to which weights 31, 32 are affixed. These weights project horizontally outwardly from the shaft, and the radial angle between the axes of the two weights is adjustable by shifting and locking the angular position of one of the weights on the shaft relative to the other weight. In this manner, the upper weight 31 can be made to lead or lag the position of the lower weight 32 by an adjustable angle. Adjustment of these weights alters the characteristics of the resultant gyratory motion, as is well understood.

I have found that the best results are obtained when the weights are set to provide an angle of 180° between weights with the lower weights 32 being heavier than the top weights 31. In practice this was accomplished by inverting the motor of an 18-inch Kason vibratory machine. This brings about the maximum fluidity in the particle bed by causing the table 14 to exhibit the maximum vertical displacement. At the same time, of course, this weight setting imparts a substantial eccentric motion to the table 14 (to which the separation head 12 is affixed) and, specifically, induces an inward thrust (or "throw") to particles contained within the separation head 12.

As already mentioned, the table 14, and thereby the frame 20 and head 12, assume a gyratory motion when the motor is in operation. Such gyratory motion has both a circularly eccentric component and an oscillatory, or repetitive, vertical component. The combination of these two motion components enables energy to be imparted to the particle bed in such a way as to achieve the desired separation action. Fluidization occurs as a result of the instantaneous spacing between individual particles of the bed. The lead angle of 180° between the upper and lower weights provides the maximum vertical oscillatory component consistent with optimum fluidization of the particle bed. The motion components result in the lateral, or translational, movement of the particles within the particle bed, this being possible due to the diminished resistance of the fluidized particle bed to individual particles moving within the bed.

Separation Head 12

The separation head 12, implementing the improvements according to the invention, will now be described. A description of the elements which are common to the present invention and to the invention of U.S. Pat. No. 4,184,725 is given first.

As described in the earlier patent, the separation head comprises a particle-supporting plate, or table 22, and an upstanding cylindrical wall 23. Securely mounted to the table 22 are five substantially concentric annular rings 36, 37, 38, 39 and 40. These rings provide reaction surfaces which act directly upon the particles to impart a net movement to them. The spaces between the rings form a plurality of generally concentric annular regions, or annular channels. The rings have restricted openings in the form of slots 43–47 in the vertical wall so as to permit radially directed migration of the particles in the fluidized bed, with the openings in adjacent ring being circumfrentially displaced by, for example, 180°.

With the foregoing configuration, particles filling the annular channels follow a generally spiral migratory path which is radially inward if the "throw" of the motor weights is directed inwardly, and which is radially outward if this "throw" is outwardly directed. I have found that the most efficient results are achieved when the throw of the eccentric motor is inwardly directed and the collection zone is at the center of the particle bed. In this case, the vertical ring 43 provides a reaction surface which defines the collection zone.

Figure 5:
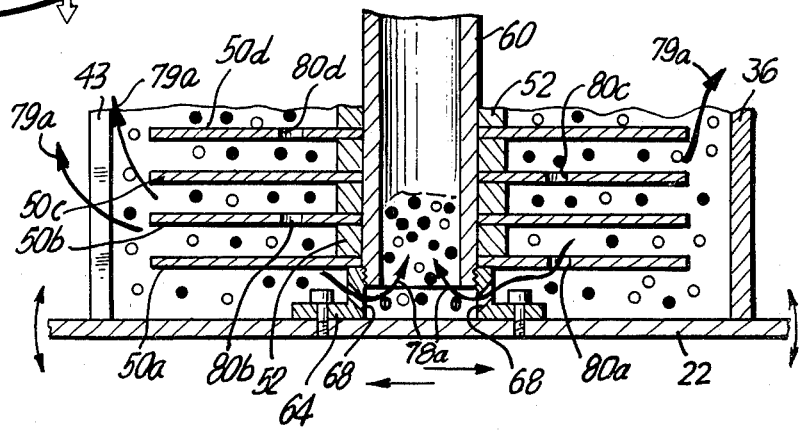
FIG. 5 is an enlarged cross-sectional view of a portion of the apparatus taken along the line 5—5 in FIG. 4 to illustrate in more detail the behavior of particles in the collection and concentration zones.

Inside the collection zone is a plurality of spaced-apart horizontal plates in the form of round disks designated 50*a*–50*e*. The spaced disks are mutually separated by cylindrical spacing elements 52. These disks 50*a*–50*e* surround an upstanding narrow cylinder or pipe 60 at the center of the particle bed. The stand pipe 60 is supported in a flange 64 that is bolted to the particle supporting plate 22, as best seen in FIG. 5. The interior of this pipe 60 constitutes a zone for the removal of densified particle concentrate. The plates 50*a*–50*e* and spacing element 52 are held firmly in position by a cylindrical collar 65 of larger diameter at the top of the plate stack, and by a threaded nut 66 which is threaded onto the pipe 60 at the top. As will be explained shortly, the function of the collar 65 is to provide an auxiliary reaction surface to aid in the dispersion of excess particles over the top of the fluidized particle bed. Particles enter the interior of the pipe 60 through passageways 68 (FIG. 5) in the flange.

Figure 2:
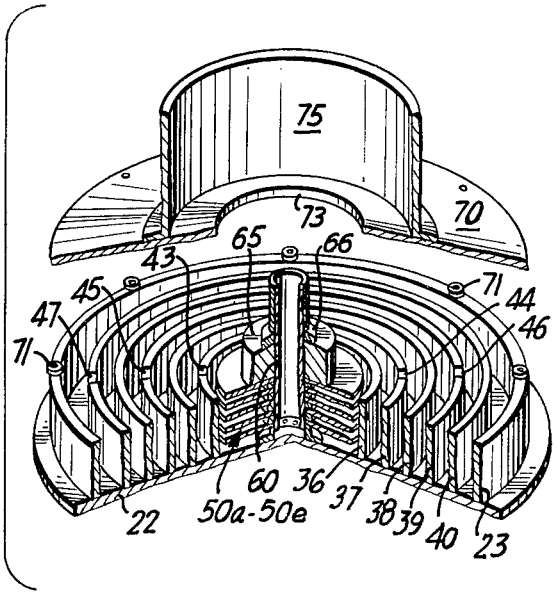
FIG. 2 is a partially exploded, cut-away perspective view of the separation head attached to the gyratory machine of FIG. 1.

Affixed to the wall 23 is a cover 70 in the form of an inverted conical section. It is separated from the wall's rim by spacing washers 71 (FIG. 2) to form a horizontal aperture 77 about substantially the entire periphery of the wall 23 near the top of the particle bed. The cover 70 has an opening 73 of larger diameter than the collar 65, and supports a particle-receiving hopper 75 that encompasses both the aperture 73 and the pipe 60.

The function of the outwardly sloping cover 70 is to provide a laterally extending reaction surface which, being directly mounted to the wall 23, has the same motion as the particle supporting table 22. During the repetitive vertical excursions of the cover 70, its undersurface contacts excess particles at the top of the particle bed and thereby imparts a downwardly directed momentum to those particles to urge at least the denser particles into the annular channels between rings 36–40. Any particles which are not received by the channels are permitted to flow outwardly as waste through the aperture 77 at the periphery of the bed. Particles are loaded into the apparatus by filling them into the hopper 75, from which they enter the particle bed via the aperture 73. The particle concentrate is extracted from the center of the stand pipe 60.

Operation

The operation of the apparatus will now be more completely described. First, as explained in my earlier U.S. Pat. No. 4,148,725, particles occupying the annular channels formed between rings 36–40 are given a net radially inward momentum, as well as a circular motion, by virtue of the eccentric component of motion of the rings. The primary effect of the vertical component of the gyratory motion is to fluidize the bed. The circumferential displacement of the restricted openings in the rings requires particles migrating within the fluidized bed to follow a circular path before reaching an opening interconnecting an adjacent annular channel. As a result, particles are given a longer residence time in the fluidized bed. Moreover, this multiple ring configuration appears to result in an increased fluid pressure which is exerted in the direction of radial thrust or, in this example, toward the center of the particle bed. Thus, generally speaking, the inwardly directed pressure is, in part, a function of the number of concentric rings that are used, several rings tending to be more effective than fewer rings in driving denser particles into the collection zone. The generally spiral paths of the denser particles in the particle bed is shown by the dark arrows 78 in FIG. 4.

Particles reaching the collection zone at the interior of the ring 43 encounter the plurality of horizontal plates 50*a*–50*e*. Because these plates are affixed to the table 22 and move with it, they too have a fluidizing influence on the particles. Specifically, they maintain the fluidity of the particles within the collection zone so that the denser particles may enter into this zone. As earlier noted, there is a general tendency of particles, particularly the fines, to become compacted in the collection zone, and compaction retards or precludes entirely the further inward advancement of particles. The spaced horizontal plates prohibit or greatly diminish this compaction by keeping the particles more fluid inside of the collection zone.

Figure 4:
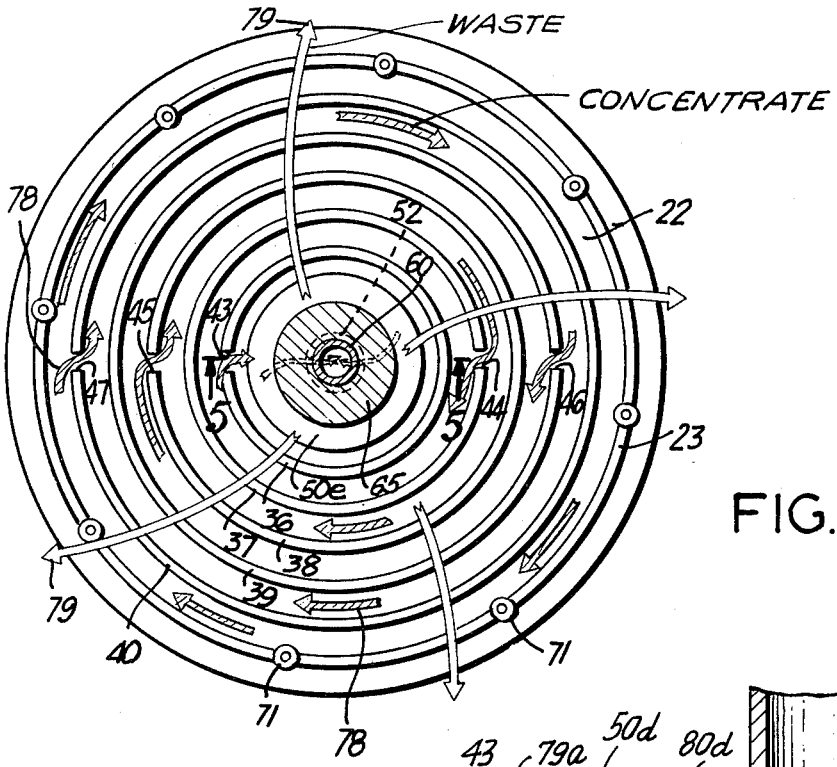
FIG. 4 is a plan view taken along the line 4—4 of the separation head of FIG. 3, with the cover removed, to show the dimensional relationship among the elements thereof and also to illustrate schematically the particle flow behavior within the separation head.

While the precise explanation for the general preference of more dense particles to migrate into the collection zone and there displace particles of lesser density is subject to some debate, one can think in terms of the inwardly directed kinetic energy or momentum of the particles. Since particles of greater density (i.e., greater mass for particles of same size) have greater momentum, they tend to displace out of the way any less dense particles, this displacement generally taking place at any surface providing resistance to the denser particle's movement. The less dense particles, on the other hand, ultimately find their way outwardly and/or upwardly to the top of the bed where they are free to flow over the tops of the rings or through the slots 43–49 to the aperture 77 at the upper periphery of the rim 23. In FIG. 4, this outward migration of the less dense particles over the tops of the rings is shown diagrammatically by the light arrows 79 pointing generally radially outwardly. The dark arrows 78 in FIG. 4 depict the motion of the denser particles.

The foregoing separation action is also pictorially represented in the enlarged view of the collection zone in FIG. 5, wherein the dark arrows 78*a* represent the path of removal of more dense particles and the light arrows 79*a* represent the net movement of the less dense particles during operation. Referring to FIG. 5, there is a preponderance of dense particles adjacent the barrier surface formed at the spacers 52. These dense particles are free to move vertically downwardly through small apertures 80*a*–80*d* in the plates 50*a*–50*d*. These apertures in adjacent horizontal plates are preferably circumferentially displaced to avoid excessive gravity effects. The dense particles, which displace less dense particles at the center of the collection zone, ultimately move to the lower level where they encounter the plurality of circumferentially spaced passageways 68 in the flange 65. These passageways provide access for the more dense particles into the center of stand pipe 60 during withdrawal of the concentrate. This concentrate within the pipe 60 is advantageously and preferably removed by suction applied either continuously or periodically at the top of the pipe 60 by a flexible coupling (not shown). Particle withdrawal is depicted by the dark arrow 86 in FIGS. 1 and 3.

From the foregoing, it should be realized that the more dense particles, which are desired to be separated out from the aggregate mass of size-classified particles in the particle bed, follow a generally spiral path into the collection zone at the center of the particle bed and tend to remain in the collection zone in preference to particles of less density. Moreover, such dense particles will displace less dense particles in the collection zone (and elsewhere in the particle bed) in the event that such less dense particles impede their radially inward migration.

The method may be carried out continuously. This is achieved by loading particles (represented by arrow 84 in FIGS. 1 and 3) into the hopper 75 at the top of the apparatus at a rate compatible with the separation and extraction of both concentrate and waste. Particles added to the hopper (arrow 84) enter into the region above the fluidized particle bed via the cover aperture 73 and encounter the cylindrical collar 65. Since this collar has the same eccentric component of motion as the other components of the apparatus, it contacts the entering particles and disperses them outwardly toward the exit aperture 77 (see arrow 79 in FIG. 4).

Figure 3:
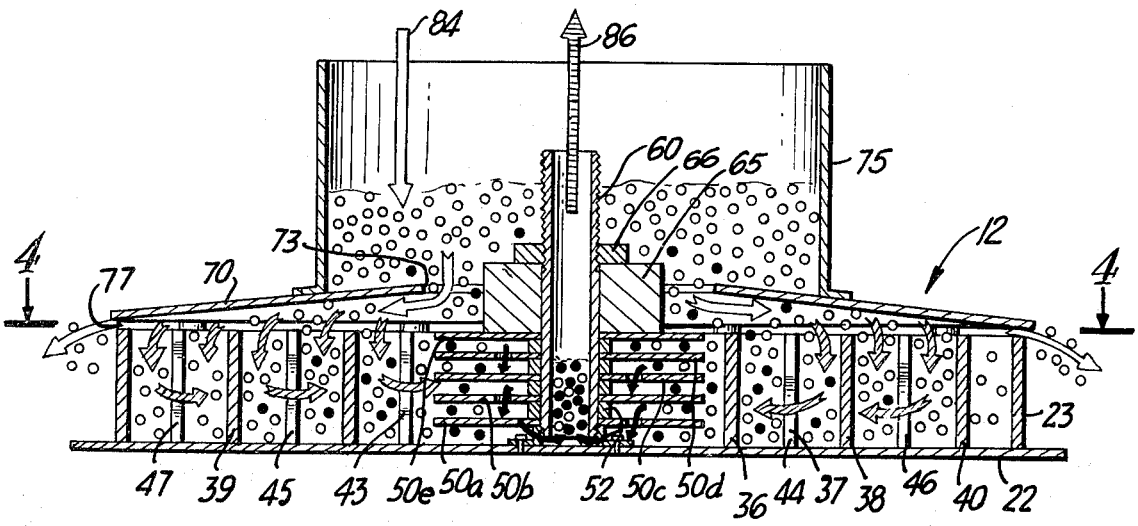
FIG. 3 is an elevational view in cross-section, taken generally along the line 3—3 in FIG. 1.

As depicted by the white arrows in FIG. 3, feed material entering the particle bed through the aperture 73 will first fill up the inner channels between rings and then overflow into the outer channels. As more feed material is introduced, it will occupy the space between the tops of the rings and the underside of the cover 70. These particles, which are termed "excess" particles, are dispersed radially outwardly by the eccentric motion of the auxiliary reaction surface of the annular collar 65. Excess particles moving outwardly over the tops of the rings are contacted by the laterally extending reaction surface of the underside of the cover 70. As already mentioned, this reaction surface has a reciprocal vertical displacement which contacts the particles and drives the denser excess particles downwardly. If the rate of flow of particles through the apparatus is properly adjusted, the residence time of excess particles in the space between the cover and the fluidized bed within the channels is such to permit a great majority of the denser particles to enter into the channels before exiting from the aperture 77. These denser particles have a preponderant tendency to enter into the channels due to the combined effect of gravity and their greater kinetic energy upon being struck by the cover.

I have found that the outwardly sloping pitch of the cover 70 is desirable in obtaining satisfactory operation. Attempts to achieve high throughput with a horizontal cover spaced above the channels were not consistently effective. The sloping cover, on the other hand, provides a larger cross-sectional material flow area per unit of circumference adjacent the point of addition of particles into the bed, this cross-sectional area gradually decreasing as the particles disperse toward the perimeter of the bed. It also places the cover's reaction surface closer to the top of the particle bed at the periphery of the bed, thus greatly enhancing the downward thrust exerted on more dense particles near the perimeter.

Table I below lists the mechanical specifications of a preferred embodiment of the apparatus which has proved effective in trial field separation of heavy metal particles from sand and gravel.

TABLE I

| Element | Dimension or Specification |
|---|---|
| Diameter of wall 23 | 17 in. |
| Width of each channel between rings 36–40 | .5 in. |
| Diameter of rings 36–40 | Selected to yield .5 in channel width |
| Width of slots 43–47 | .5 in. |
| Height of rings 36–40 | 2 in. |
| Number of plates 50 | 6 |
| Diameter of plates 50 | 5 in. |
| Spacing between plates 50 | .25 in. |
| Diameter of stand pipe 60 | 1 in. |
| Height of stand pipe 60 | 5 in. |
| Diameter of aperture 73 | 4 in. |
| Diameter of collar 65 | 3 in. |
| Height of collar 65 | 1–1 in. |
| Diameter of hopper 75 | 9 in. |
| Slope pitch of cover 70 | $\frac{1}{4}$ in.–$\frac{3}{4}$ in. rise per 7 in. radius |
| Motor | $\frac{1}{3}$ hp, 1140 rpm |
| Weights 31 | 5.125 lbs. |
| Weights 32 | 5.875 lbs. |
| Weight Lead Angle | 180° |
| Aperture 77 | Variable |

Generally speaking, the width of the aperture 77 will vary according to the size of the particles in the feed material. As a rule, the aperture has a dimension about of 2–3 times the dimension of the largest particle in the feed material. For example, where the largest particle in the feed material has a nominal diameter of $\frac{1}{4}$ in., the aperture 77 is selected to be about $\frac{1}{2}$ in.–$\frac{3}{4}$ inch.

The width of the channels, i.e., the spacing between adjacent annular rings may be similarly varied. I have found, for example, that a channel with a $\frac{3}{8}$ in. works best for $-30$ $+50$ mesh ore, a channel width of $\frac{1}{2}$ in. performs well with $-\frac{1}{8}$ in. $+16$ mesh and $-16$ $+30$ mesh ores, and that a $\frac{5}{8}$ in. width is preferred for $-\frac{1}{4}$ $+\frac{1}{8}$ ore. Also, the rate of flow through the apparatus can vary considerably according to the feed material, as well as the entrance and exit aperture dimensions.

Best results are achieved when all particles in the bed have a narrow size classification. Exemplary particle classifications for good separation are as follows:

(a) $\frac{1}{2}$ in.–$\frac{1}{4}$ in., (b) $\frac{1}{4}$ in.–$\frac{1}{8}$ in., (c) $-16$ $+30$ mesh, (d) $-30$ $+40$ mesh, and (e) $-50$ $+100$ mesh. Particle classification is generally achieved at low cost by common screening methods familiar to those in the art.

The following examples are illustrative of the operative results from laboratory and field experiments. Except as otherwise noted the apparatus used possessed the physical specifications of Table I.

EXAMPLE A

The separation head was filled with 16.4 pounds of sand which had been classified to $-30$ $+50$ mesh. A feed batch was made by admixing 16.7 grams of $-40$ $+50$ mesh iron shot with 30 pounds of $-30$ $+50$ mesh sand. The motor was turned on and the sand shot mixture was poured into the hopper 75 at a rate of 12 pounds per minute. The separation head was operated for a period of about three minutes until no further waste material was discharged from the aperture 77. Thereupon, vacuum was applied to the open end of the pipe 60 and the motor turned off. Next, the cover 77 was removed in order to gain access to the interior of the separation head. Particulate material was removed from various sections of the separation head and separately weighed. The results are reported in Table A below.

TABLE A

| Location of Material Weighed | Weight of Sand | Weight of Iron Shot |
|---|---|---|
| Feed material | 30.0 lbs. | 16.7 grams |
| Total separation head at start | 16.4 lbs. | 0 grams |
| Discharged waste material | 36.0 lbs. | 2.4 grams |
| Material in outer channels | 5.0 lbs. | 2.6 grams |
| Material in collector channel | .4 lbs. | .7 grams |
| Material between horizontal plates 50 | 1.0 lbs. | 4.7 grams |
| Concentrate removed by vacuum from pipe 60 | 4.0 lbs. | 6.0 grams |
| Total separation head at finish | 10.4 lbs. | 14.0 grams |

The foregoing results show a recovery of iron shot of 14.0/16.7=0.84 (84%). Moreover, of the 14 grams of shot recovered, 11.4/16.7 (68%) was concentrated in the collection and concentrate zones of the separation head. Continued operation of the separation head, as would normally occur during a continuous separation operation, would result in essentially all of the shot ending up in the collection zone.

For purposes of comparison, the same tests were run on the separation head with the cover 70 removed in order to evaluate the contribution of the cover to the separation process. Start-up conditions were 16.4 lbs. of sand in the separation head at the beginning of the test. Once again, 16.4 grams of −40 +50 iron shot was admixed with 32 pounds of −30 +50 sand. The motor was turned on and the sand/iron shot mixture was poured into the center of the collection zone at a rate of 6.5 pounds per minute. The separation head was operated about five minutes, until no waste material flowed over the wall 23. As before, vacuum was applied to the open end of the pipe 60 and the motor turned off. Next, the lid was removed and the material at various sections of the separation head was weighed. The results are listed below in Table B.

TABLE B

| Location of Material | Weight of Sand | Weight of Iron Shot |
|---|---|---|
| Feed material | 32.0 lbs. | 16.4 grams |
| Total separation head at start | 16.4 lbs. | 0 grams |
| Discharged waste material | 32.0 lbs. | 6.8 grams |
| Material in outer channels | 10.0 lbs. | 6.0 grams |
| Material in collector channel | .4 lbs. | .5 grams |
| Material between horizontal plates 50 | 1.3 lbs. | 1.5 grams |
| Concentrate removed by vaccum via pipe 60 | 4.7 lbs. | 2.0 grams |
| Total separation head at finish | 16.4 lbs. | 10.0 grams |

The rate of recovery in this test was 10.0/16.7=0.64, or 64% recovery of the iron shot from the 30 lbs. mixture. Of the recovered shot, 4.0/16.4, or 24%, was found in the collection and concentration zones.

Example B evidences the positive effect of the cover upon the separation process. With the cover in place, a faster through-put was realized—12 lbs/min. as opposed to only 6.5 lbs./min. without the cover. In addition, a higher rate of recovery was realized with the cover in place—84% (cover) as compared with 63% (no cover). Finally, a higher concentration of the iron shot was found within the collection and concentrate zones of the apparatus with the cover in place—68% (cover) vs. 24% (no cover).

A quantity of dry gold-bearing placer ore was classified −16 +30 mesh and divided into batches of from 60 lbs. to 70 lbs. for processing through the separator head. The ore was not assayed. Each batch was fed through the separator at a rate of from 10 lbs./min. to 15 lbs./min., and the motor was allowed to run until no further waste was ejected from the exist aperture. The lid was removed and the total contents of the separator head were panned by hand to locate any free gold particles. The waste was collected and similarly panned by hand. The gold recovered from the separator head was weighed separately from any gold recovered from the waste. Based on the weight of the panned gold, the recovery rate for the gold particles ranged from about 90% to 100%, with average in excess of about 95%.

In performing the runs of Example C, all elements of the apparatus had the dimensions and specifications set forth above in TABLE I.

Figure 6:
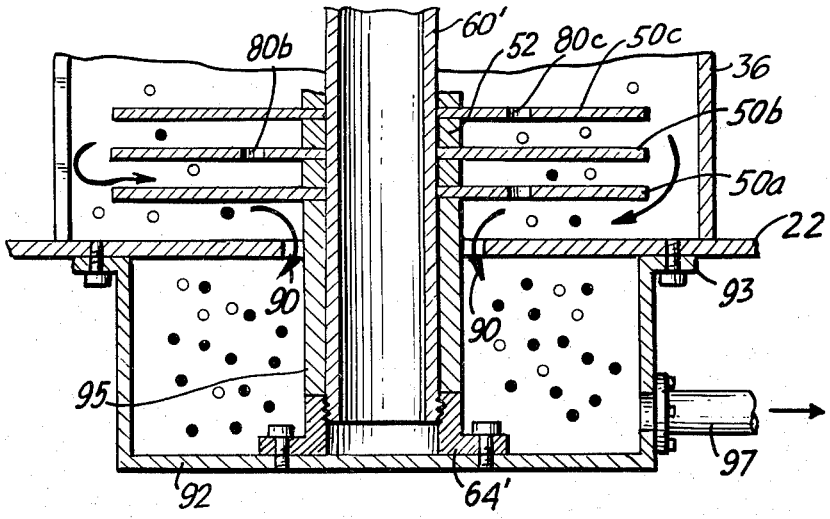
FIG. 6 is an enlarged cross-sectional view similar to FIG. 5 but depicting an alternate embodiment of the invention.

FIG. 6 shows an alternate embodiment of the collection and concentrate sections of the apparatus. The fundamental difference of the alternate embodiment resides in a relocation of the zone from which concentrate is removed. Instead of extracting particles via the column 60, a concentrate-accumulating region is established beneath the gyratory support table 22, and particles in the collection region are permitted to fall through one or more apertures in the table into this lower region.

As clearly illustrated in FIG. 6, the collection zone of the apparatus remains substantially unchanged, the zone being defined by the annular ring 36 and including the stack of horizontal plates 50*a*–50*e*, spaces 52 and column 60′. In this case, however, the column extends through the center of a circular aperture 90 in the table 22 and mounts to a flange 64′ affixed to the bottom of a cylindrical concentrate box 92. This box is constructed of heavy guage aluminum, such as $\frac{1}{8}$ in.–$\frac{1}{4}$ in. having a diameter of about 3 in., and includes a horizontal flange 93 about its upper edge for the purpose of securely bolting the box 92 to the underside of the table. The horizontal plate stack in the collection zone is located at the desired vertical position by an extended spacer 95 which is supported at the top of the flange 64′. Thus, the horizontal plate stack is supported by the floor of the concentrate box 92, and an annular opening formed between the spacer 95 and the aperture 90.

Operation of the embodiment shown in FIG. 6 is substantially the same as that described above, except that the more dense particles arriving at the collection zone do not enter the interior of the column 60 but, rather, are permitted to enter by gravity into the interior of the concentrate box 92. This box may be periodically emptied of its contents by withdrawing the particles through the exit conduit 97. I have found that a vacuum applied to the conduit 97 removes most of the particles from concentrate box, as well as most of the particles between the horizontal plate 50*a*–50*b* in the collection zone.

The embodiment of FIG. 6 is highly effective in upgrading or densifying particulate ore at a through-put rate greater that that achieved by extracting the concentrate through the interior of the column 60. The embodiment of FIG. 6 makes possible the use of a larger aperture for the entry of particles into the zone of concentration and also permits the more dense particles to enter this zone aided by the influence of gravity.

It should be noted, with respect to FIG. 6, that the particles passing through aperture 90 need not necessarily be collected in the box 92. For example, particles entering aperture 90 may be conveyed via a conduit to remote locations which, if such conduit is flexible, can be disassociated from the moving components of the separation head.

The present invention provides a significant improvement in the separation of dry particles according to density. Through the use of the several refinements described and claimed herein, separation of dense particles from less dense particles may be carried out faster, with a higher rate of recovery and with improved concentration within the collection zone. In addition, the invention can be applied to both coarse and fine particle feed material and, especially, material having a particle size of −50 mesh or finer. In addition to the other advantages, the configuration of the apparatus permits convenient and effective continuous feeding and withdrawal of the material without shutting down the apparatus.

It is an important aspect of the invention that it can effectively upgrade raw particulate ores and thereby render economic certain particulate ores which heretofore have been uneconomic. For example, a gold placer, having an assay value of 0.01 ounce of recoverable free gold per ton of particulate ore at a gold price of $400.00 per ounce, contains gold valued at $4.00 per ton. If such ore must be transported to a source of water for conventional recovery processing, the transportation costs alone can approach the value of the ore. The present process and apparatus is capable of concentrating the raw ore from 0.01 ounce per ton to to 0.10 ounce per ton concentrate. In other words, this ore can be upgraded by a factor of ten, to reduce transportation costs by the same factor. An ore which is fundamentally uneconomic or only marginally economic may thus be concentrated to a degree permitting the concentrated ore to be transported at economic cost to a remote location for further processing.

It is to be understood that the foregoing description of the preferred embodiments of the invention is illustrative only and that certain modifications and variations can be implemented in both the process and the apparatus without departing from the invention. As one example, ore concentrate may be removed from the so-called concentrate region by any suitable means, and by paths other than those specifically disclosed herein. Additionally, changes in the relative dimensions of the elements may be made according to the requirements of the feed material. Furthermore, the term "adjacent annular regions" as used herein does not connote regions that are necessarily continguous but, rather, annular regions that communicate for the movement of particles.

What I claim is:

1. In a process for separating particles of selected relative density from an aggregated group of particles of predetermined size having different individual densities, wherein the particles are disposed upon a supporting surface in a particle bed, the particle bed is contacted by vertical reaction surfaces defining at least two intercommunicating annular channels, the vertical reaction surfaces having an eccentric lateral motion component and the supporting surface having a vertical motion component, said motion components fluidizing the particle bed to reduce the resistance thereof to lateral movement of individual particles therewithin, and moving such particles in a direction toward a collection zone bounded by one of said vertical reaction surfaces, the steps of:

simultaneously contacting the particles of said bed in said collection zone with a plurality of vertically spaced horizontal reaction surfaces disposed in said collection zone so as to enhance the fluidity of particles therewithin, thereby to enable denser particles to move into and remain in the collection zone in preference to less dense particles; and providing a vertical barrier surface adjacent said collection zone to which denser particles may move laterally between said horizontal reaction surfaces and there remain in preference to less dense particles.

2. The method of claim 1, wherein:

said vertical barrier surface is an annular surface generally concentric with said vertical reaction surface.

3. The method of claim 1, further comprising:

providing a region separated from said collection zone and defining a particle concentrate zone, and providing an aperture adjacent said vertical barrier surface so as to permit denser particles to pass therethrough into said concentrate zone for removal.

4. The method of claim 3, further comprising:

extracting particles from said concentrate zone.

5. The method of claim 4, wherein:

particles are extracted by applying suction to said concentrate zone.

6. The method of claim 3, further comprising:

providing passages through said horizontal reaction surfaces adjacent said vertical barrier surface, whereby denser particles are permitted to move vertically through said passages in a direction toward said area of communication between the collection and concentration zones.

7. The method of claim 6, wherein:

said area of communication is located in a lower portion of said vertical barrier surface, whereby more dense particles located between said horizontal reaction surfaces are permitted to move downwardly toward said area of communication.

8. The method of claim 3, wherein:

the concentrate zone is separated from the collection zone by said vertical barrier surface, and said aperture extends through said vertical barrier surface.

9. The method of claim 3, wherein:

said concentrate zone is disposed at a level below said supporting surface and said aperture extends through said supporting surface.

10. The method of claim 1, further comprising:

contacting any excess particles at the top of the particle bed with an auxiliary vertical reaction surface having an eccentric transverse motion to exert a force on excess particles inducing them to move laterally over the top of said vertical reaction surfaces, whereby excess particles are dispersed laterally at the top of said bed in order to permit selected particles to enter said annular channels.

11. The method of claim 10, further comprising:

contacting said dispersed particles with a laterally extending surface having a repetitive vertical displacement relative to said dispersed particles so as to drive the more dense particles contacted thereby into at least one of said annular channels.

12. The method of claim 1, wherein:

said collection zone is disposed at the center of said fluidized bed and is surrounded by at least one annular channel.

13. A method for concentrating particles of relatively greater density contained in an aggregated mass of particles of selected size having different densities, comprising:

disposing the particles on a generally horizontal supporting surface to form a particle bed;

agitating said supporting surface with a motion effective to fluidize the particle bed and thereby reduce the resistance of said bed to the lateral movement of particles therein;

simultaneously contacting the particles in said fluidized bed with a plurality of spaced apart annular vertical reaction surfaces moveable with the supporting surface and having a laterally eccentric motion effective to induce a lateral movement of particles within the fluidized particle bed, said vertical reaction surface defining at least one collection region and at least one adjacent annular region;

providing limited areas of communication between adjacent annular regions for the net movement of particles of relatively greater density therethrough from said one region into said collecting region;

adding particles to said fluidized particle bed in an amount sufficient to raise the particle bed to a level permitting excess particles to disperse laterally over the top of at least one of said vertical reaction surfaces; and contacting said particles at the top of said fluidized bed with a laterally extending reaction surface having a reciprocal vertical motion relative to said dispersed particles so as to cause excess particles of greater density to enter said annular regions within the fluidized bed in preference to particles of lesser density.

14. The method of claim 13, further comprising:

permitting excess particles to exit from said particle bed at a location remote from said collection region, whereby dispersed excess particles at the top of said fluidized bed and not entering said annular regions may continuously exit from the bed.

15. The method of claim 14, wherein:

said excess particles are permitted to exit at the periphery of the particle bed, whereby said excess particles move generally radially outwardly toward the point of exit, while more dense particles may be driven downwardly into said fluidized bed by said laterally extending reaction surface.

16. The method of claims 13, 14 or 15, further comprising:

contacting said added particles with an auxiliary vertical reaction surface adjacent the point at which particles are added to said particle bed, said auxiliary reaction surface having a laterally eccentric motion imparting to said added particles a movement which is generally counter to the net direction of more dense particles within the fluidized particle bed, thereby tending to disperse said added particles over the top of said fluidized particle bed.

17. The method of claim 14, wherein:

said laterally extending reaction surface is sloped downwardly from the point of particle addition to the exit aperture, said sloped surface having an entrance aperture therein for the reception of added particles.

18. The method of claim 17, wherein:

said entrance aperture is at the center of said sloped reaction surface and said excess particle exit at the periphery of the bed.

19. The method of claim 13, further comprising:

extracting from said fluidized bed the more dense particles collected in said collection region.

20. A method for concentrating particles of selected relative density from an aggregated mass of size-classified particles having different individual densities, comprising:

disposing said particles upon a laterally extending supporting surface to form a particle bed;

agitating said supporting surface with a motion effective to fluidize said particle bed and thereby reduce the resistance thereof to lateral movement of particles therewithin;

simultaneously contacting the particles in said fluidized bed with a plurality of annular vertical reaction surfaces movable with the supporting surface and having a laterally eccentric motion, said vertical reaction surfaces defining a plurality of adjacent annular regions;

providing areas of limited communication between adjacent regions so as to permit the movement of particles from one region to the next toward a collection region;

simultaneously contacting the particles of said fluidized bed in said collection region with a plurality of mutually spaced, horizontal reaction surfaces so as to enhance the fluidity of particles therewithin and thereby to permit the more dense particles to move into and remain in the collection zone in preference to particles of lesser density;

contacting any excess particles at the top of said fluidized bed with an auxiliary vertical reaction surface having a laterally eccentric motion, thereby to disperse excess particles in a direction counter to the net direction of dense particles within the fluidized bed;

contacting said dispersed particles at the top of said fluidized bed with a laterally extending reaction surface having a vertical repetitive motion relative to the particle bed, thereby to drive at least the denser excess particles into the fluidized bed within said annular regions, and permitting less dense excess particles to exit from the particle bed.

21. The method of claim 20, wherein:

said generally horizontal reaction surfaces have a smaller radial dimension than a vertical reaction surface defining said collection zone, thereby to provide an annular gap between said vertical reaction surface and said horizontal vertical reaction surfaces.

22. An apparatus for separating particles of selected relative density from an aggregated group of particles of predetermined size, having different individual densities, comprising:

a lateral surface for supporting a bed of particles disposed thereon;

means for agitating said supporting surface with a motion effective to fluidize said particle bed and thereby reduce the resistance of said bed to the lateral movement of particles therein;

a plurality of spaced-apart annular vertical reaction surfaces movable with said lateral supporting surface and defining at least one collection region and at least one adjacent annular region, said vertical reaction surfaces having passages therethrough for intercommunicating adjacent ones of the annular regions;

means for giving said annular vertical reaction surfaces a laterally eccentric motion so as to contact the particles in said fluidized bed and induce a lateral movement of particles therewithin toward said collection region;

a plurality of vertically spaced horizontal reaction surfaces disposed in said collection region and movable with the supporting surface so as to enhance the fluidity of particles therewithin, thereby to enable denser particles to move into and remain in the collection zone in preference to less dense particles; and means providing a vertical barrier surface in said collection zone to which more dense particles may move laterally between said horizontal reaction surfaces and there remain in preference to less dense particles.

23. Apparatus according to claim 22, further comprising:

means defining a concentrate zone separated from said collection region and communicating therewith through an aperture for the passage of more dense particles from the collection region into the concentrate zone.

24. Apparatus according to claim 23, wherein:

said aperture extends through the supporting surface at a location adjacent said vertical barrier surface.

25. Apparatus according to claim 24, wherein:

said concentrate zone is disposed at a level below said supporting surface.

26. An apparatus according to claim 20, wherein:

said vertical barrier surface is an annular surface generally concentric with said vertical reaction surface.

27. An apparatus according to claim 26, wherein:

said barrier surface defines a concentrate zone within said collection region for the removal of concentrate from the particle bed, said barrier surface having at least one passage therethrough so as to permit more dense particles arriving thereat to pass into said concentrate zone.

28. An apparatus according to claim 27, wherein:

said horizontal reaction surfaces have apertures therethrough adjacent said vertical barrier surface whereby denser particles are permitted to move vertically through said apertures toward said passage.

29. Apparatus according to claim 28, wherein:

said passage in the barrier surface is located in the lower portion thereof, whereby particles of greater density disposed between said horizontal reaction surfaces may move downwardly and thence pass through said passage.

30. Apparatus according to claim 25, further comprising:

a lid vertically spaced from said annular reaction surfaces and movable with said supporting surface for contacting and inducing at least some of any excess particles at the top of the particle bed to move into said annular regions.

31. Apparatus according to claim 30, further comprising:

an auxiliary vertical reaction surface movable with the supporting surface and disposed in an upper region of the particle bed, said auxiliary reaction surface contacting and dispersing excess particles laterally over the tops of said annular reaction surfaces, thereby permitting said dispersed particles to be contacted by said lid and driven thereby into the fluidized particle bed.

32. Apparatus according to claim 31, wherein:

said auxiliary vertical reaction surface is convexly curved.

33. Apparatus according to claim 30, further comprising:

means defining an aperture at the periphery of said fluidized particle bed for the exit of any excess particles not received by said annular regions.

34. Apparatus for concentrating particles of relatively greater density contained in an aggregated mass of particles of selected size, having different densities, comprising:

means providing a lateral supporting surface for said particles to form a particle bed:

means for agitating said supporting surface to fluidize the particle bed and thereby reduce the resistance of said bed to the lateral movement of particles therewithin:

a plurality of spaced-apart annular vertical reaction surfaces defining a collection region and at least one adjacent annular region within the particle bed, said annular surfaces being movable with the supporting surface in a laterally eccentric motion to induce a lateral movement of particles in the fluidized particle bed;

said annular reaction surfaces having limited areas of communication therethrough for the net movement of particles of relatively greater density from said one annular region into said collection region; and a lid at the top of said fluidized bed and movable with the supporting surface so as to contact any excess particles at the top of the fluidized bed and urge the particles of greater density therein to enter said annular region in preference to particles of lesser density.

35. Apparatus according to claim 34, further comprising:

means defining an exit aperture communicatable with said particle bed at a location remote from said collection region, whereby less dense excess particles dispersed across the top of said fluidized bed and not entering said annular regions may continuously exit from the particle bed.

36. Apparatus according to claim 35, wherein:

said exit aperture is disposed at the periphery of said particle bed, whereby excess particles move generally radially outwardly toward the point of exit while particles of relatively greater density contacted by said lid are driven downwardly into said fluidized bed.

37. Apparatus according to claim 34, 35 or 36, further comprising:

an auxiliary vertical reaction surface movable with the supporting surface for contracting and imparting to said excess particles a lateral movement which is generally counter to the net direction of more dense particles within the fluidized particle bed, thereby tending to laterally disperse any excess particles over the top of said annular vertical reaction surfaces for contacting by said lid.

38. Apparatus according to claim 34, wherein:

said lid is sloped downward from the point of particle addition to the exit aperture, said lid having an entrance aperture therein for the reception of added particles.

39. Apparatus according to claim 37, further comprising:

hopper means coupled to said laterally extending reaction surface for receiving and storing at least a restricted quantity of particles to be added to the particle bed, said lid having an opening therethrough adjacent the auxiliary reaction surface for admitting particles into the particle bed.

40. Apparatus according to claim 34, further comprising:

means for admitting particles into the fluidized bed at an upper level thereof.

41. Apparatus according to claim 34, further comprising:

means defining a vertical barrier surface within said collection region to which denser particles may move laterally and there remain in preference to less dense particles, and means for extracting particles from the particle bed at a location adjacent to said barrier surface.

42. Apparatus according to claim 34, wherein said extracting means includes:

means defining an aperture in said supporting surface for withdrawing particles from the particle bed.

43. Apparatus for concentrating particles of relatively greater density contained in an aggregated mass of classified particles having different densities, comprising:

a lateral supporting surface for the particles to form a particle bed;

a plurality of radially spaced rings carried by said supporting surface and defining at least one collection region and at least one adjacent annular region, one of said rings having a restricted opening therein to permit the limited passage of particles between annular regions;

means for imparting to said supporting surface a gyratory-like motion having a repetitive vertical motion component and a laterally eccentric motion component, said motion being effective to fluidize the particle bed to reduce the resistance thereof to individual particle movement therewithin and to induce a net lateral movement of the denser particles toward said collection region; and means associated with said collection region for enhancing the fluidity of particles therewithin while permitting denser particles to move into said collection region and there remain in preference to particles of less density.

44. Apparatus for concentrating particles of relatively greater density contained in an aggregated mass of classified particles having different densities, comprising:

a lateral supporting surface for the particles to form a particle bed;

a plurality of radially spaced rings carried by said supporting surface and defining at least one collection region and at least one adjacent annular region, one of said rings having a restricted opening therein to permit the limited passage of particles between annular regions;

means for imparting to said supporting surface a gyratory-like motion having a repetitive vertical motion component and a laterally eccentric motion component, said motion being effective to fluidize the particle bed to reduce the resistance thereof to individual particle movement therewithin and to induce a net lateral movement of the denser particles toward said collection region; and means for dispersing excess particles over the top of the fluidized particle bed; and means for imparting a downward momentum to said dispersed particles to urge at least the denser of said excess particles to enter the fluidized particle bed of at least one of said regions.

* * * * *